US008875968B2

(12) United States Patent
Tan

(10) Patent No.: US 8,875,968 B2
(45) Date of Patent: Nov. 4, 2014

(54) MULTI-USE BAG DISPENSER

(71) Applicant: Daniel Brian Tan, Harahan, CA (US)

(72) Inventor: Daniel Brian Tan, Harahan, CA (US)

( * ) Notice: Subject to any disclaimer, the term of this patent is extended or adjusted under 35 U.S.C. 154(b) by 0 days.

(21) Appl. No.: 13/869,795

(22) Filed: Apr. 24, 2013

(65) Prior Publication Data

US 2014/0048576 A1 Feb. 20, 2014

Related U.S. Application Data

(63) Continuation of application No. PCT/US2012/051601, filed on Aug. 20, 2012.

(51) Int. Cl.
*B26F 3/02* (2006.01)

(52) U.S. Cl.
USPC ..... 225/45; 225/47; 225/10

(58) Field of Classification Search
USPC ..... 225/16, 10, 39, 47, 50, 66, 45, 6
See application file for complete search history.

(56) References Cited

U.S. PATENT DOCUMENTS

| | | | | | |
|---|---|---|---|---|---|
| 2,334,689 | A | * | 11/1943 | Wooster | 242/595.1 |
| 2,452,299 | A | * | 10/1948 | Gould | 225/22 |
| 2,462,776 | A | | 2/1949 | Price | |
| 3,702,672 | A | * | 11/1972 | Becht | 225/106 |
| 3,770,222 | A | * | 11/1973 | Jespersen | 242/560.3 |
| 4,884,734 | A | | 12/1989 | Kahl, Jr. et al. | |
| 5,219,424 | A | * | 6/1993 | Simhaee | 225/47 |
| 5,261,585 | A | * | 11/1993 | Simhaee | 225/47 |
| 5,307,969 | A | * | 5/1994 | Menendez | 225/42 |
| 5,556,019 | A | * | 9/1996 | Morris | 225/96 |
| 5,706,993 | A | * | 1/1998 | DeMatteis | 225/106 |
| 5,934,535 | A | * | 8/1999 | Kannankeril et al. | 225/106 |
| 6,230,952 | B1 | | 5/2001 | Jupiter | |
| 6,279,806 | B1 | | 8/2001 | Simhee | |
| 6,450,380 | B1 | | 9/2002 | Simhaee | |
| 6,481,594 | B1 | | 11/2002 | Yeh et al. | |
| 6,561,403 | B1 | * | 5/2003 | Kannankeril et al. | 225/96 |
| 6,966,473 | B1 | | 11/2005 | Hayden | |
| 7,128,251 | B1 | * | 10/2006 | Galle | 225/2 |
| 7,270,256 | B2 | * | 9/2007 | Daniels | 225/93 |
| 7,591,405 | B2 | * | 9/2009 | Daniels | 225/93 |
| 8,251,270 | B2 | * | 8/2012 | Tseng | 225/47 |
| 8,393,509 | B2 | * | 3/2013 | Greg | 225/93 |
| 2002/0160896 | A1 | * | 10/2002 | Yeh et al. | 493/180 |

(Continued)

FOREIGN PATENT DOCUMENTS

JP 2002-187648 A 7/2002

*Primary Examiner* — Sean Michalski
(74) *Attorney, Agent, or Firm* — David A. Belasco; Belasco Jacobs & Townsley, LLP

(57) ABSTRACT

A multi-use dispenser for roll mourned bags includes a planar base with at least one mounting feature and a bag roll support. The support is attached to the base and is spaced upwardly there from. First and second core guides, spaced apart by at least a width of a bag roll, extend upwardly adjacent first and second ends of the bag roll support. A pair of primary bag roll retainers includes a first side guard and a second side guard mounted orthogonally to the first and second core guides, orthogonally to a long axis of the bag roll support, and spaced apart by at least the width of the bag roll. The side guards have angled brackets at their outer ends. The side guards constrain ejection of a bag roll. At least one snagging device is mounted to engage a central portion of a bag attached to the bag roll.

10 Claims, 7 Drawing Sheets

(56) References Cited

U.S. PATENT DOCUMENTS

| | | | | |
|---|---|---|---|---|
| 2002/0170937 | A1* | 11/2002 | Yeh et al. | 225/39 |
| 2004/0007607 | A1* | 1/2004 | Daniels | 225/93 |
| 2005/0098600 | A1* | 5/2005 | Yeh et al. | 225/93 |
| 2007/0051771 | A1* | 3/2007 | Daniels | 225/93 |
| 2009/0008422 | A1* | 1/2009 | Daniels | 225/46 |
| 2010/0044392 | A1* | 2/2010 | Burli et al. | 221/30 |
| 2010/0067831 | A1* | 3/2010 | Alvarado et al. | 383/37 |
| 2011/0073629 | A1* | 3/2011 | Tseng | 225/51 |
| 2012/0024884 | A1* | 2/2012 | Wilfong | 221/30 |
| 2012/0125970 | A1* | 5/2012 | Tsui | 225/106 |
| 2012/0228246 | A1* | 9/2012 | Alvarado et al. | 211/59.2 |
| 2012/0305619 | A1* | 12/2012 | Tan | 225/106 |
| 2013/0134181 | A1* | 5/2013 | Helseth et al. | 221/26 |
| 2014/0144966 | A1* | 5/2014 | Tan | 225/47 |

* cited by examiner

MULTI-USE BAG DISPENSER

RELATED APPLICATIONS

The instant application is a continuation of Application Serial No. PCT/US12/51601, filed Aug. 20, 2012 and claims priority to the filing date thereof and incorporating the same by reference in its entirety.

FIELD OF INVENTION

The invention pertains to dispensers for plastic and other film bags typically used for produce or other merchandise. More particularly, the invention relates to dispensers for vertically folded bags that are packaged in compact bag rolls with or without cores.

BACKGROUND OF THE INVENTION

Plastic and other film produce bags are commonly used in supermarkets, grocery stores and other markets where sanitation and ease of use in limited spaces are important factors. These bags have advantages in that they are relatively inexpensive to produce, provide substantial carrying capacity and may include easy opening features. In order to make these bags easier to handle and use, they are usually used in combination with a dispensing rack. As the bag roll decreases in size as bags are removed from the roll, it is important that the remaining bag roll stay within the dispenser and not fall out onto the floor of the store or market, as this can lead to accidents. It is also important that the bag dispenser be easy to refill and provide visual cues when refilling becomes necessary. The dispenser should be easy to clean and take up a minimum of space. Various designs have been developed for dispensing roll mounted bags, although none provide all of the features of the present invention.

Materials used for the construction of dispensers for roll mounted bags can have a significant effect upon the suitability of the dispensing system for different environments. Traditionally, such dispensing racks have been fabricated from steel wire and plate that is then chrome plated or painted. Such construction has the advantage of rigidity and longevity, but is also subject to rust, and corrosion in damp environments. In addition, such dispensers are heavy and relatively expensive to produce. To address these problems associated with steel and other metal dispensing racks, the inventor has turned to modem, high strength plastics for rack construction. For the purposes of this application, it should be understood that "wire" should be accorded it broadest reasonable reading. Wire need not be conductive, made of metal or have a solid core. In some embodiments chrome or nickel plated metal will be desirable, in other embodiments polymer coated metal, or non-metallic wire such as polyoxymethylene, also known as polyacetal, acetal resin, polytrioxane, polyformaldehyde, commonly known as DuPont Delrin®, may be used. Structural rigidity, porosity and resistance to moisture absorption are important criteria in selecting the appropriate materials. Any material now known or later discovered, possessing sufficient rigidity, and not susceptible to significant moisture absorption may be used. Material specifically contemplated by the inventor include, without limitation, high density polyethylene (HDPE), high molecular weight polyethylene, polycarbonate; sold under such trade names as Lexan®, Markrolon® and Calibre®, acrylonitrile butadiene styrene, known as ABS, and poly amide 66, also know as DuPont Nylon 66® or Zytel®. For purposes of this application, the term wire will be understood to include materials made from ferrous and non-ferrous metals, coated and uncoated, and various polymeric materials such as plastics, including but not limited to, those described above.

U.S. Pat. No. 6,481,594, issued to Yeh et al. is directed to a roll mounted T-shirt style produce bag and dispensers for same. The dispensers are used for roll mounted plastic produce bags and include a supporting base with a surrounding upper member. The dispenser includes a pair of front edge members and a pair of rear edge members which are configured to receive and slidably constrain first and second ends of a cylindrical produce bag core on which the bags are wound into a roll. Thus, these front and rear edges are provided in order to hold a small bag roll from falling out of the dispenser. Further, the dispensers include a constraining ring that includes upper and lower separating tongues which are fixed to the hag constraining ring. Thus, the roll may be arranged to dispense bags from either the top or bottom of the roll utilizing either the upper or lower separating tongues each of which engage the U-shaped cutout in the upper portion of hag. Pre-Grant Publication 2005/0098600, published for the same inventor, is directed to a streamlined folded T-shirt style produce hag for roll mounting and shows a dispenser with both upper and lower separating tongues fixed to a bag constraining ring.

U.S. Pat. Nos. 6,561,403 and 5,914,535, both issued to Kannankeril et al., disclose a bag separator and dispenser and a bag dispensing system. Both of these references show a variety of bag dispenser systems that are used to dispense vertically folded produce bags and include side shields or protectors in order to prevent the rolled systems from falling out of the dispensers.

U.S. Pat. Nos. 6,450,380, 6,279,806 and 6,450,380 issued to Simhaee are all directed to a plastic hag dispenser and again, a variety of dispensers that utilize either cored rolls or non-core rolls with dispensers that show side retaining capabilities so that the rolls do not fall from the dispenser are seen.

U.S. Pat. No. 6,966,473, issued to Hayden is directed to a wrapping material dispenser system wherein a flat wrapping material 24 is dispensed from a rolled quantity of the material 24 held within the dispenser system 10 comprising a housing 12 with a bottom wall 14 and a perimeter wall 16. The to portion 18 of housing 12 has a slit 22 through which the material 24 is dispensed. Of particular importance is the fact that material 24 may be dispensed toward a front perimeter wall 16 as well as toward a rear perimeter wall so that a portion may be obtained by cutting utilizing one of a pair of cutter assemblies 28 each with blade portion 38 so that the material may be pulled toward the front or rear of the dispenser.

U.S. Pat. No. 4,884,734 is directed to a tape dispenser and U.S. Pat. No. 2,462,776 is directed to a cover for open tissue roll holders and both of these references provide additional examples of material dispensed from a rolled material and pulled in one of two different directions with cutters or edges provided in each direction so that a portion of the material may be available in each of the pulled directions.

U.S. Pat. No. 7,128,251 issued to Galle is directed to a stackable bag and roll dispensing system wherein the dispenser includes a support member 12 and a stop bar 13 which are used to retain the roll of bags within the dispenser in order to prevent it from falling out. Again, the dispensing system seen in this reference is used for dispensing thermoplastic bags from a roll of bags that are of the vertically folded type.

While other variations exist, the above-described designs for roll mounted bag dispensers are typical of those encountered in the prior art. It is an objective of the present invention to provide for a compact roll-mounted hag dispenser that takes up a minimum of floor or counter spaces and that can dispense bags train the front or rear of the dispenser. It is a further objective to provide a dispenser that will not permit a bag roll to be inadvertently ejected or removed from the dispenser. It is yet a further objective to provide a dispenser that will work with bags on cored rolls where the core is either flush with the bag roll sides or protruding. It is a still further objective of the invention to provide a dispenser that will work with careless bag rolls. Finally, it is an objective of the invention to provide a hag dispenser that is sturdy, easy to clean and economical to produce.

While some of the objectives of the present invention are disclosed in the prior art, none of the inventions found include all of the requirements identified.

SUMMARY OF THE INVENTION

The present invention addresses all of the deficiencies of prior art roll mounted bag dispenser inventions and satisfies all of the objectives described above.

(1) A multi-use dispenser for roll mounted bags providing the desired features may be constructed from the following components. A planar base is provided. The base has at least one mounting feature for attaching to either of a surface and a mounting system. A vertical bag constraining support is provided. The support has a top end, a bottom end and is sized and shaped to control movement of a smaller size bag roll. The constraining support is attached at the bottom end to the planar base. A bag roll support is provided. The bag roll support is attached to the top end of the bag constraining support.

First and second core guides are provided. Each of the core guides extends upwardly adjacent first and second ends of the bag roll support. The core guides are spaced apart by at least a width of a bag roll.

At least one pair of primary bag roll retainers is provided. The pair of primary bag roll retainers includes a first side guard and a second side guard. The first and second side guards are mounted orthogonally to the first and second core guides, orthogonally to a long axis of the bag roll support, and are spaced apart by at least the width of the bag roll. The first and second side guards have inward facing angled brackets at their respective distal ends. The first and second side guards are sized, shaped and located to constrain ejection of either of a full sized and smaller size bag roll.

(2) In a variant of the invention, at least one pair of secondary bag roll retainers is provided. The pair of secondary bag roll retainers includes a third side guard and a fourth side guard. The third and fourth side guards are mounted orthogonally to the first and second core guides, orthogonally to the long axis of the bag roll support, and are spaced apart by at least the width of the bag roll. The third and fourth side guards have inward facing angled brackets at their respective distal ends. The third and fourth side guards are mounted below the first and second side guards, respectively and above the bag roll support. The third and fourth side guards have a length less than a length of the first and second side guards and are sized, shaped and located to constrain ejection of either of a partial and reduced size bag roll.

(3) in another variant, the at least one pair of primary bag roll retainers includes front facing and rear facing first and second side guards.

(4) In still another variant, the at least one pair of secondary bag roll retainers includes front facing and rear facing third and fourth side guards.

(5) in yet another variant, the at least one snagging device includes a front facing snagging device and a rear facing snagging device.

(6) In a further variant, the inward facing angled brackets are orthogonal to a long axis of the first and second side guards.

(7) in still a further variant, the inward facing angled brackets are orthogonal to a long axis of the third and fourth side guards.

(8) In yet a further variant, at least one core entry guide is provided. The entry guide is located at an upper end of either of the first or second core guides and extends outwardly parallel to the long axis of the bag support for a first predetermined distance. At least one guide rail is provided. The guide rail descends vertically from the entry guide to either of the first and second ends of the bag roll support. The guide rail is centrally located between front and rear sides of either of the first or second core guides. A core pin is provided. The core pin has a diameter sized to fit slidably within a bag roll mounted on a hollow core.

(9) In another variant of the invention, the at least one guide rail further includes a first guide rail. The first guide rail is centrally located between front and rear sides of the first core guide. A second guide rail is provided. The second guide rail is centrally located between front and rear sides of the second core guide. The core pin is sized to fit between the first guide rail and the second guide rail.

(10) in still another variant, the core pin further includes at least one notch at an end of the core pin. The notch is sized, shaped and located to fit slidably about the at least one guide rail.

(11) In yet another variant, the core pin further includes at least one notch at at least one end of the care pin. The notch is sized, shaped and located to fit slidably about either of the first guide rail or the second guide rail.

(12) In a further variant, a retaining device is provided. The retaining device flexibly attaches the core pin to the dispenser.

(13) In still a further variant, the retaining device is selected from the group includes chain, wire, cord, and plastic line.

(14) In a final variant of the invention, the dispenser is of wireform construction.

An appreciation of the other aims and objectives of the present invention and an understanding of it may be achieved by referring, to the accompanying drawings and the detailed description of a preferred embodiment.

DETAILED DESCRIPTION OF THE PREFERRED EMBODIMENT

The present invention addresses all of the deficiencies of prior art multi-use bag dispenser inventions and satisfies all of the objectives described above.

Figure 1:
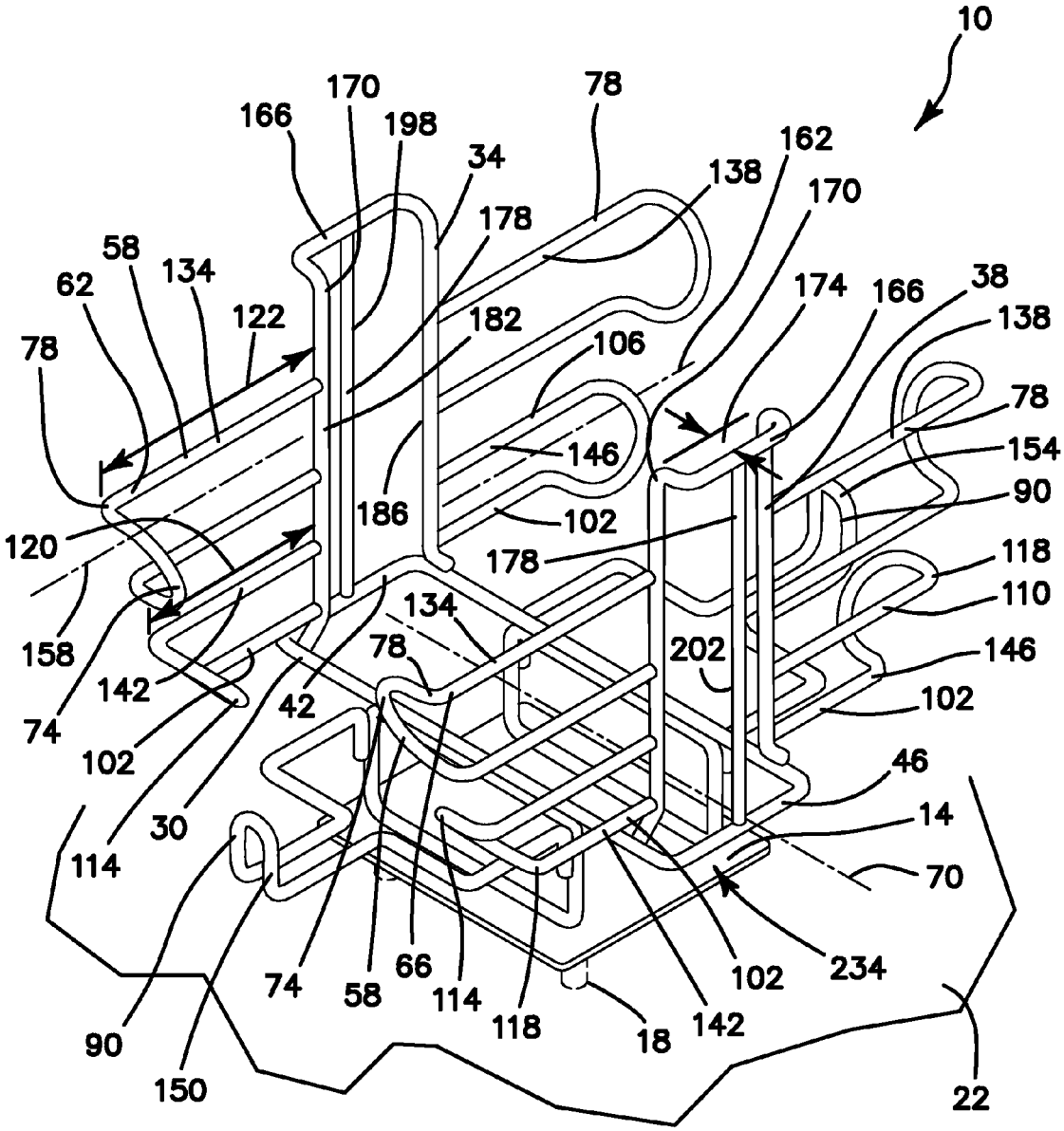
FIG. 1 is a perspective view of a preferred embodiment of the invention.
Figure 2:
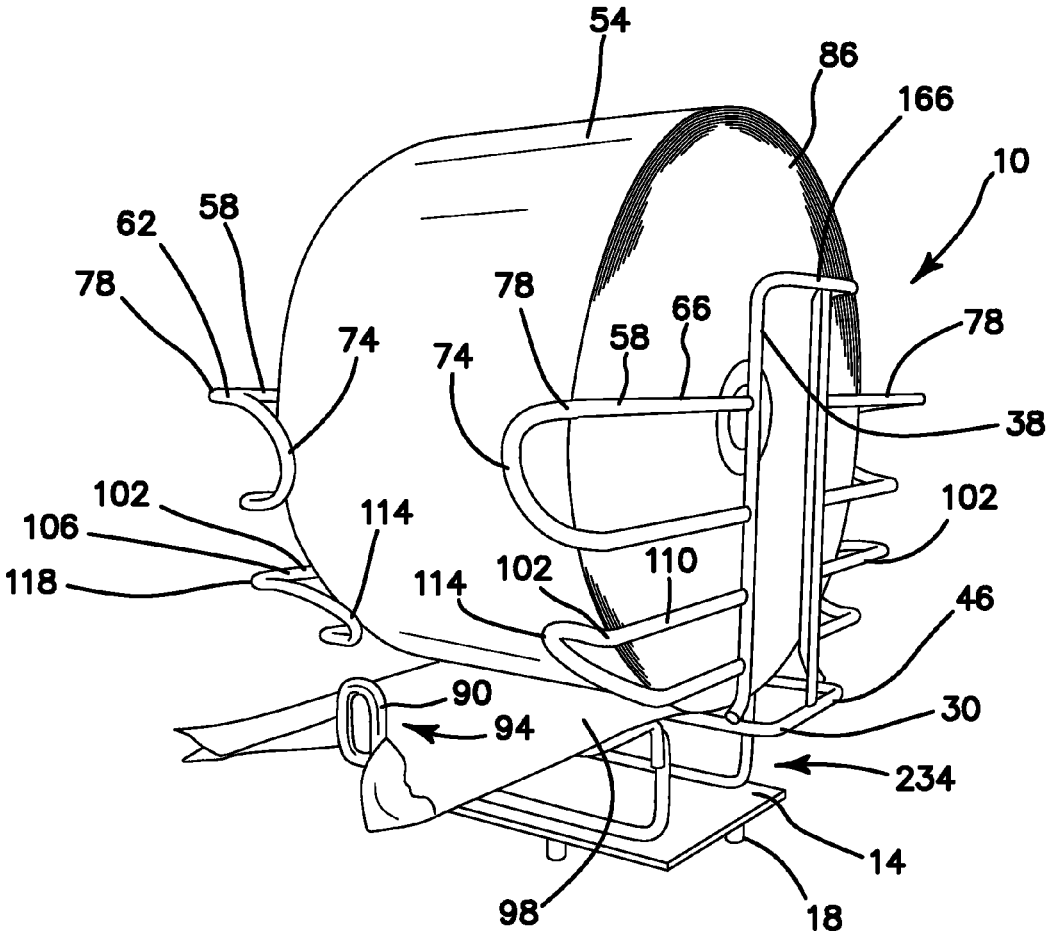
FIG. 2 is a perspective view of the FIG. 1 embodiment illustrating a bag roll with attached core installed.
Figure 3:
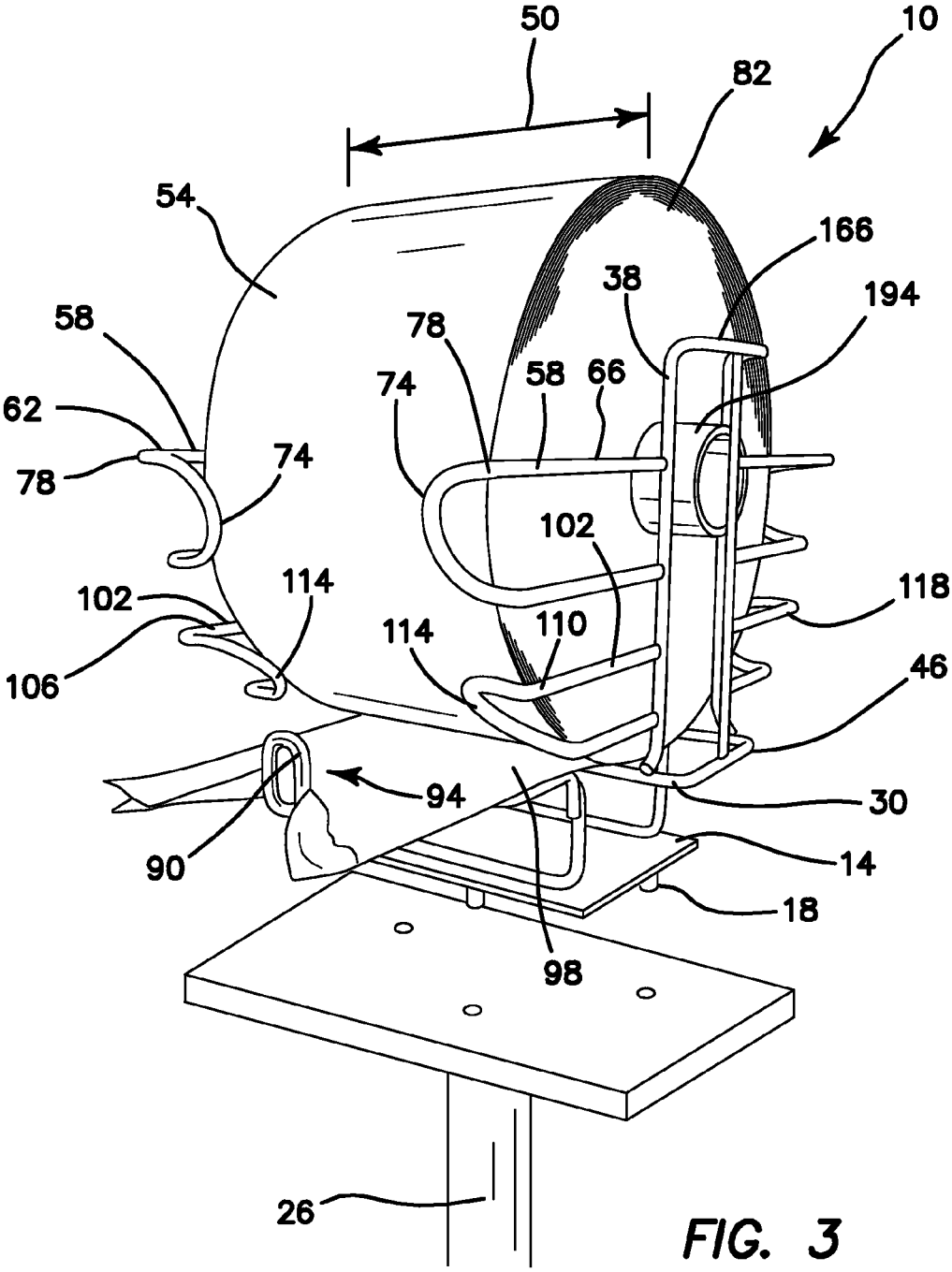
FIG. 3 is a perspective view of the FIG. 1 embodiment illustrating, a bag roll with attached, extended core installed and mounting fixture displayed.
Figure 4:
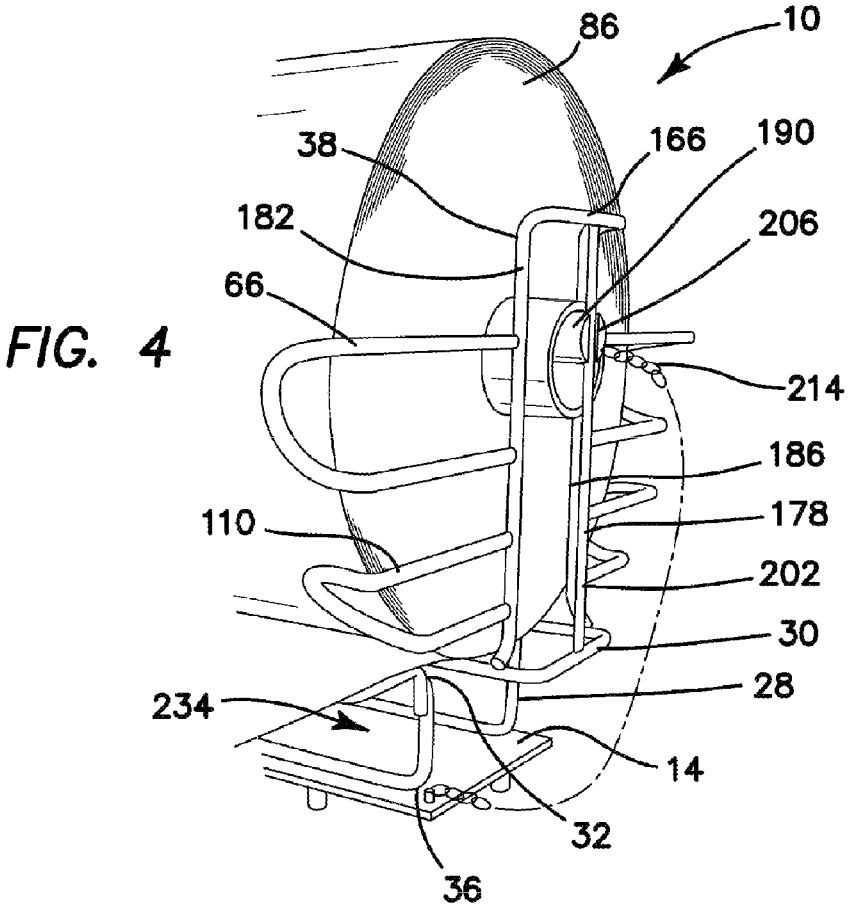
FIG. 4 is a perspective view of the slotted core pin and retainer of the FIG. 3 embodiment shown with a large bag roll in place and a removable core pin and retainer installed.
Figure 5:
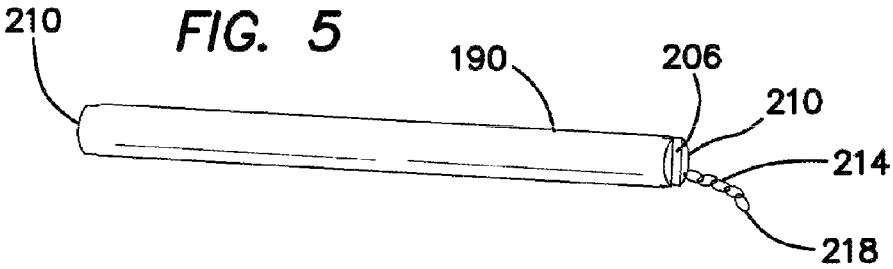
FIG. 5 is a perspective view of the slotted core pin and chain retainer of the FIG. 3 embodiment.
Figure 6:
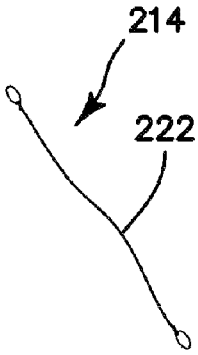
FIG. 6 is a perspective view of a wire retainer.
Figure 7:
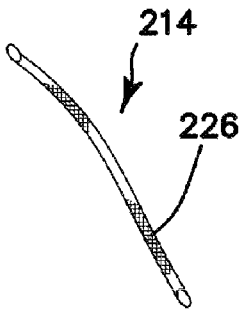
FIG. 7 is a perspective view of a cord retainer.
Figure 8:
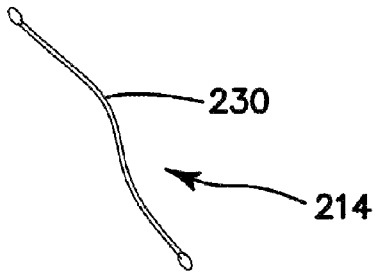
FIG. 8 is a perspective view of a plastic line retainer.
Figure 9:
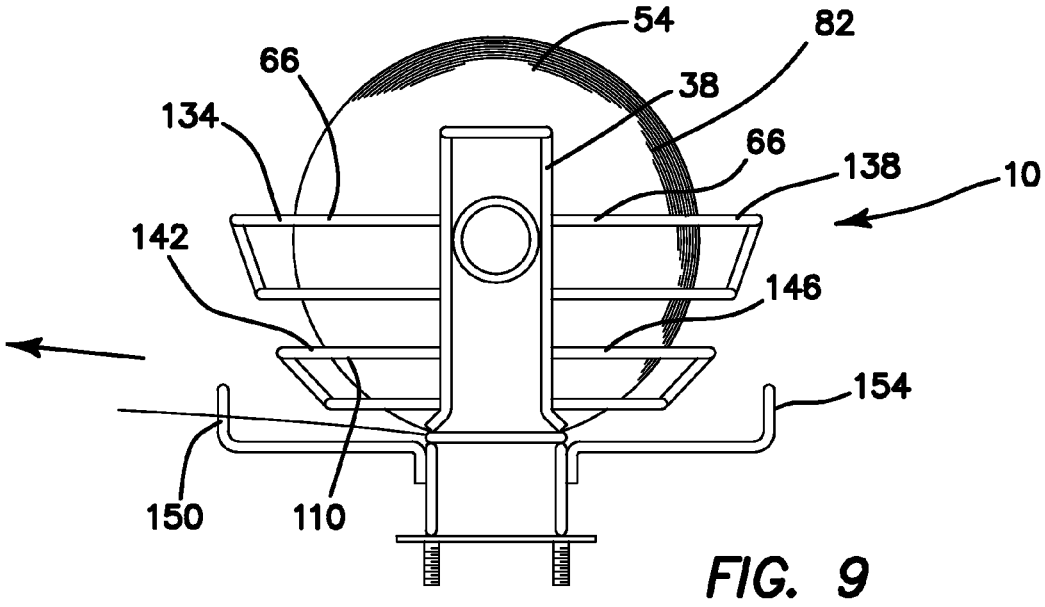
FIG. 9 is a side elevational view of the FIG. 1 embodiment illustrating full bag roll being dispensed toward the front of the dispenser.
Figure 10:
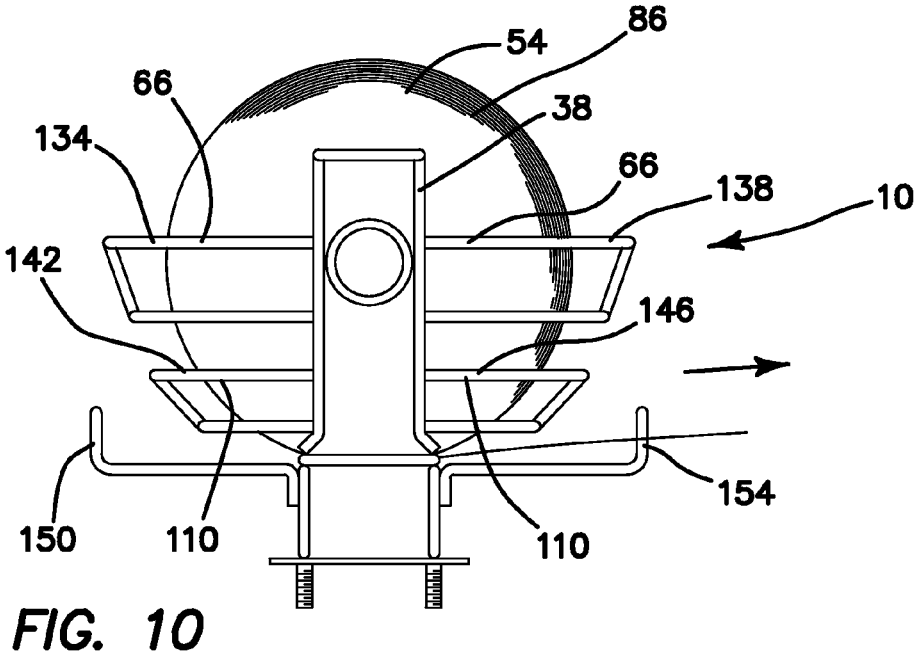
FIG. 10 is a side elevational view of the FIG. 1 embodiment illustrating large bag roll being dispensed toward the rear of the dispenser.
Figure 11:
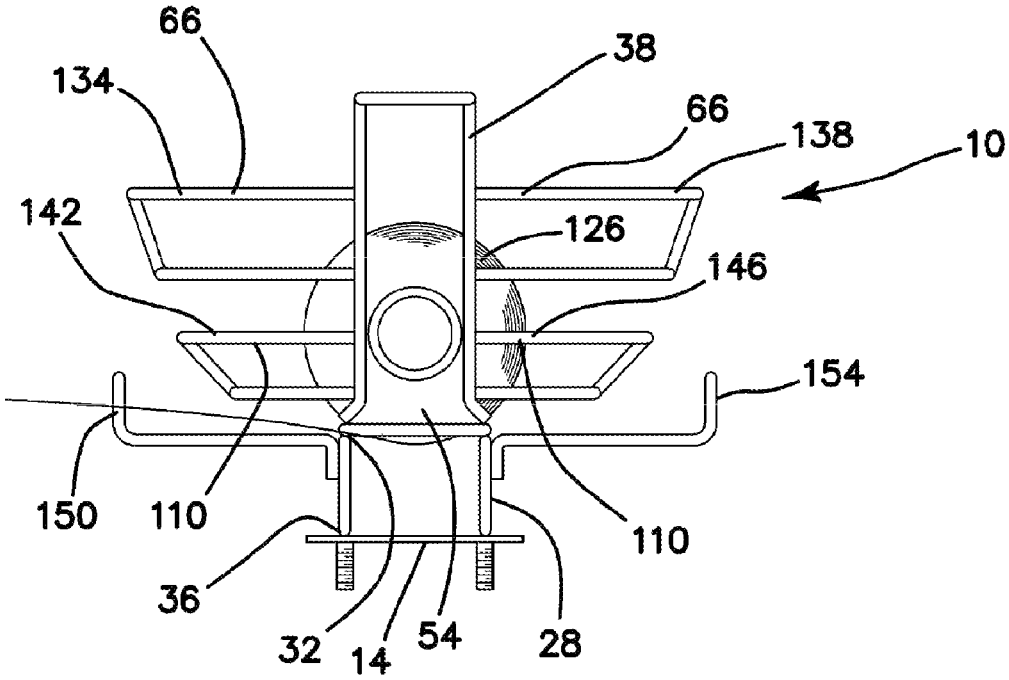
FIG. 11 is a side elevational view of the FIG. 1 embodiment illustrating partial bag roll being dispensed toward the front of the dispenser.
Figure 12:
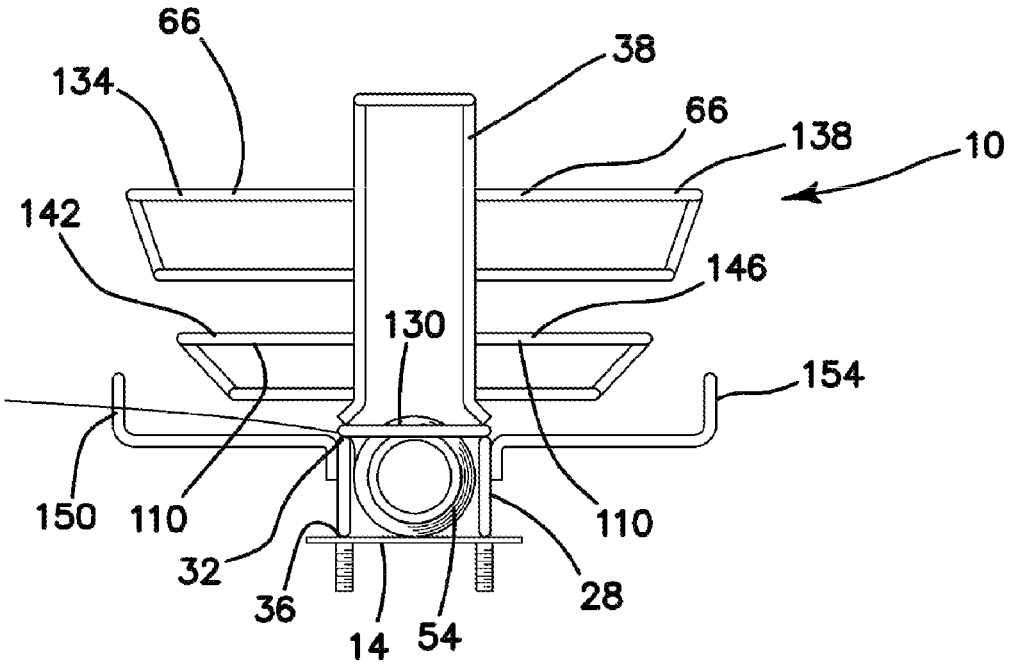
FIG. 12 is a side elevational view of the FIG. 1 embodiment illustrating reduced bag roll being dispensed toward the front of the dispenser and resting below the bag roll support.
Figure 13:
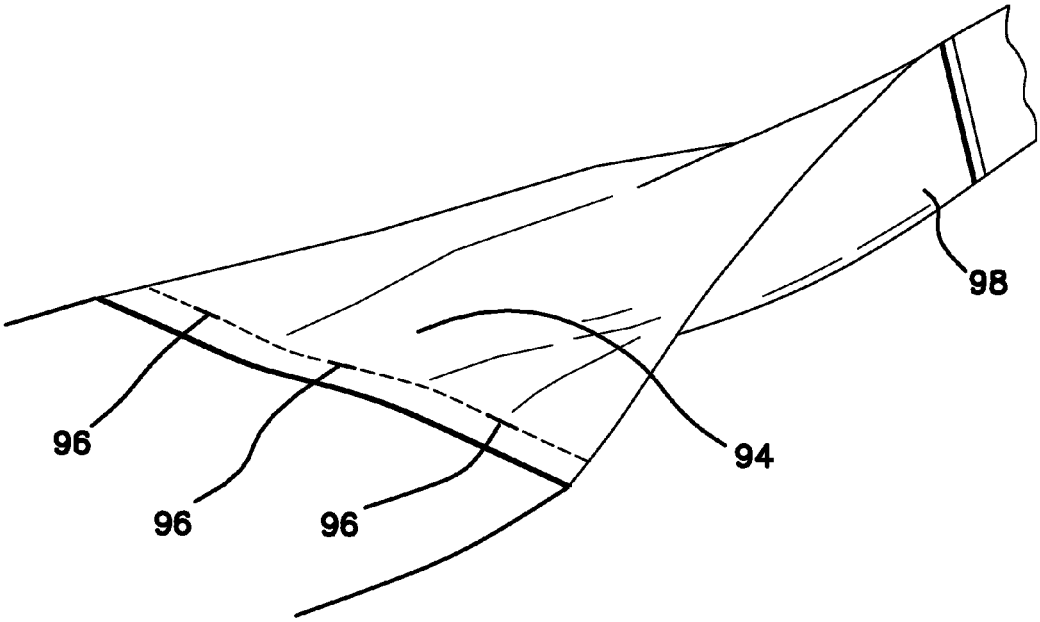
FIG. 13 is a perspective view of a vertically folded bag for use in the FIG. 1 embodiment dispenser illustrating multiple chisel cuts.

(1) FIGS. 1-13 illustrate a multi-use dispenser for roll mounted bags 10 providing the desired features that may be constructed from the following components. As illustrated in FIGS. 1-4, planar base 14 is provided. The base 14 has at least one mounting feature 18 for attaching to either of a surface 22 and a mounting system 26. A vertical bag roll constraining support 28, the support 28 having a top end 32, a bottom end 36 and being sized and shaped to control movement of a smaller size bag roll 54, said constraining support 28 is attached at the bottom end 36 to the planar base 14.

A bag roll support 30 is provided. The bag roll support 30 is attached to the top end 32 of the bag roll constraining support 28. First 34 and second 38 core guides are provided. Each of the core guides 34, 38 extends upwardly adjacent first 42 and second 46 ends of the bag roll support 30. The core guides 34, 38 are spaced apart by at least a width 50 of a bag roll 54.

At least one pair of primary bag roll retainers 58 is provided. The pair of primary bag roll retainers 58 includes a first side guard 62 and a second side guard 66. The first 62 and second 66 side guards are mounted orthogonally to the first 34 and second 38 core guides, orthogonally to a long axis 70 of the bag roll support 30, and are spaced apart by at least the width 50 of the bag roll 54. The first 62 and second 66 side guards have inward facing angled brackets 74 at their respective distal ends 78. The first 62 and second 66 side guards are sized, shaped and located to constrain ejection of either of a full sized 82 and age smaller size [86] bag roll 54.

(2) in a variant of the invention, at least one pair of secondary bag roll retainers 102 is provided. The pair of secondary bag roll retainers 102 includes a third side guard 106 and a fourth side guard 110. The third 196 and fourth 110 side guards are mounted orthogonally to the first 34 and second 38 core guides, orthogonally to the long axis 70 of the bag roll support 30, and are spaced apart by at least the width 50 of the bag roll 54. The third 106 and fourth 110 side guards have inward facing angled brackets 114 at their respective distal ends 118. The third 106 and fourth 110 side guards are mounted below the first 62 and second 66 side guards, respectively and above the bag roll support 39. The third 106 and fourth 110 side guards have a length 120 less than a length 122 of the first 62 and second 66 side guards and are sized, shaped and located to constrain ejection of either of a partial 126 and reduced 130 size bag roll 54. See FIGS. 11 and 12.

(3) in another variant, as illustrated in FIGS. 1 and 9-12, the at least one pair of primary bag roll retainers 58 includes front facing 134 and rear facing 138 first 62 and second 66 side guards.

(4) In still another variant, the at least one pair of secondary bag roll retainers 102 includes front facing 142 and rear facing 146 third 106 and fourth 110 side guards.

(5) in yet another variant, the at least one snagging device 90 includes a front facing snagging device 150 and a rear facing snagging device 154.

(6) In a further variant, the inward facing angled brackets 74 are orthogonal to a long axis 158 of the first 62 and second 66 side guards.

(7) In still a further variant, the inward facing angled brackets 114 are orthogonal to a long axis 162 of the third 106 and fourth 110 side guards.

(8) in yet a further variant, at least one core entry guide 166 is provided. The entry guide 166 is located at an upper end 170 of either of the first 34 or second 38 core guides and extends outwardly parallel to the long axis 70 of the bag support 30 for a first predetermined distance 174. At least one guide rail 178 is provided. The guide rail 178 descends vertically from the entry guide 166 to either of the first 42 and second 46 ends of the bag roll support 30. The guide rail 178 is centrally located between front 182 and rear 186 sides of either of the first 34 or second 38 core guides. As illustrated in FIG. 4-8, a core pin 190 is provided. The core pin 190 has a diameter sized to fit slidably within a bag roll 54 mounted on a hollow core 194.

(9) in another variant of the invention, the at least one guide rail 178 further includes a first guide rail 198. The first guide rail 198 is centrally located between front 182 and rear 186 sides of the first core guide 34. A second guide rail 202 is provided. The second guide rail 292 is centrally located between front 182 and rear 186 sides of the second core guide 38. The core pin 190 is sized to fit between the first guide rail 198 and the second guide rail 202.

(10) in still another variant, the core pin 190 further includes at least one notch 206 at an end 210 of the core pin 199. The notch 206 is sized, shaped and located to fit slidably about the at least one guide rail 178.

(11) In yet another variant, the core pin 190 further includes at least one notch 296 at at least one end 210 of the core pin 190. The notch 206 is sized, shaped and located to fit slidably about either of the first guide rail 198 or the second guide rail 202.

(12) In a further variant, a retaining device 214 is provided. The retaining device 214 flexibly attaches the core pin 199 to the dispenser 10.

(13) In still a further variant, the retaining device 214 is selected from the group includes chain 218, wire 222, cord 226, and plastic line 230.

(14) In a final variant of the invention, the dispenser 10 is of wireform construction 234.

An appreciation of the other aims and objectives of the present invention and an understanding of it may be achieved by referring to the accompanying drawings and the detailed description of a preferred embodiment.

What is claimed is:

1. A multi-use bag dispenser for roll mounted bags comprising:

a planar base, said base having at least one mounting feature for attaching to either of a surface and a mounting system;

a vertical bag constraining support, said support having a top end, a bottom end and being sized and shaped to control movement of a smaller size bag roll, said constraining support attached at said bottom end to said planar base;

a bag roll support, said bag roll support being attached to said top end of said bag constraining support;

first and second core guides, each of said core guides extending upwardly adjacent first and second ends of said bag roll support and being spaced apart by at least a width of a bag roll;

at least one core entry guide, said entry guide disposed at an upper end of either of said first and second core guides and extending outwardly in a direction parallel to said long axis of said bag support for a first predetermined distance;

first and second guide rails, said guide rails descending vertically from said entry guide to either of said first and second ends of said bag roll support and being centrally disposed between front and rear sides of said first and second core guides;

a core pin, said core pin having a diameter sized to fit slidably within a bag roll mounted on a hollow core;

said core pin being sized to fit between said first guide rail and said second guide rail;

said core pin further having at least one central notch extending across a diameter of at least one end of said core pin, said notch being sized, shaped and disposed to fit slidably about either of said first guide rail and said second guide rail;

at least one pair of primary bag roll retainers, said pair of primary bag roll retainers comprising a first side guard and a second side guard, said first and second side guards being mounted orthogonally to said first and second core guides, orthogonally to a long axis of said bag roll support, and being spaced apart by at least said width of said bag roll;

said first and second side guards having inward facing angled brackets at their respective distal ends and being sized, shaped and disposed to constrain ejection of either of a full sized and said smaller size bag roll; and at least one snagging device, said snagging device being mounted orthogonally to said long axis of said bag roll support and disposed to engage either of a central portion and at least one chisel cut of a bag attached to said bag roll.

2. The multi-use bag dispenser for roll mounted bags, as described in claim 1, further comprising:

at least one pair of secondary bag roll retainers, said pair of secondary bag roll retainers comprising a third side guard and a fourth side guard, said third and fourth side guards being mounted orthogonally to said first and second core guides, orthogonally to a long axis of said bag roll support, and being spaced apart by at least said width of said bag roll;

said third and fourth side guards having inward facing angled brackets at their respective distal ends, being mounted below said first and second side guards, respectively and above said bag roll support; and said third and fourth side guards having a length less than a length of said first and second side guards and being sized, shaped and disposed to constrain ejection of either of a partial and reduced size bag roll.

3. The dispensing rack for roll mounted bags, as described in claim 2, wherein said at least one pair of secondary bag roll retainers comprises front facing and rear facing third and fourth side guards.

4. The multi-use bag dispenser for roll mounted bags, as described in claim 2, wherein said inward facing angled brackets are orthogonal to a long axis of said third and fourth side guards.

5. The dispensing rack for roll mounted bags, as described in claim 1, wherein said at least one pair of primary bag roll retainers comprises front facing and rear facing first and second side guards.

6. The multi-use bag dispenser for roll mounted bags, as described in claim 1, wherein said at least one snagging device comprises a comprises a front facing snagging device and a rear facing snagging device.

7. The multi-use bag dispenser for roll mounted bags, as described in claim 1, wherein said inward facing angled brackets are orthogonal to a long axis of said first and second side guards.

8. The multi-use bag dispenser for roll mounted bags, as described in claim 1, further comprising a retaining device, said retaining device flexibly attaching said core pin to said dispenser.

9. The multi-use bag dispenser for roll mounted bags, as described in claim 8, wherein said retaining device is selected from the group comprising: chain, wire, cord, and plastic line.

10. The multi-use bag dispenser for roll mounted bags, as described in claim 1, wherein said dispenser is of wireform construction.

* * * * *